US006595259B2

(12) United States Patent
Whitby

(10) Patent No.: US 6,595,259 B2
(45) Date of Patent: Jul. 22, 2003

(54) VACUUM ACTUATED LABEL APPLYING WAND

(75) Inventor: Michael A. Whitby, West Milton, OH (US)

(73) Assignee: Premark FEF L.L.C., Wilmington, DE (US)

( * ) Notice: Subject to any disclaimer, the term of this patent is extended or adjusted under 35 U.S.C. 154(b) by 59 days.

(21) Appl. No.: 09/757,249

(22) Filed: Jan. 9, 2001

(65) Prior Publication Data

US 2002/0088553 A1 Jul. 11, 2002

(51) Int. Cl.[7] ..... B65C 9/08; B65C 9/26; B65C 9/28

(52) U.S. Cl. ..... 156/556; 156/566; 156/571; 156/DIG. 37; 156/DIG. 38

(58) Field of Search ..... 156/556, 566, 156/542, DIG. 31, DIG. 37, DIG. 28, 567, 568, 571, 572, DIG. 33, DIG. 38

(56) References Cited

U.S. PATENT DOCUMENTS

| | | | | |
|---|---|---|---|---|
| 4,217,164 A | | 8/1980 | La Mers | 156/541 |
| 4,355,967 A | | 10/1982 | Hellmer | 425/503 |
| 4,561,921 A | | 12/1985 | Treiber | 156/297 |
| 4,787,953 A | | 11/1988 | Trouteaud et al. | 156/387 |
| 4,895,614 A | | 1/1990 | Trouteaud et al. | 156/542 |
| 5,221,405 A | | 6/1993 | Trouteaud | 156/364 |
| 5,645,680 A | | 7/1997 | Rietheimer | 156/567 |
| 5,833,803 A | | 11/1998 | Strohmeyer et al. | 156/517 |
| 5,897,741 A | | 4/1999 | Mills et al. | 156/541 |
| 6,009,926 A | | 1/2000 | Vicktorius et al. | 156/556 |
| 6,230,779 B1 | * | 5/2001 | Anderson et al. | 156/542 |

FOREIGN PATENT DOCUMENTS

| | | | | |
|---|---|---|---|---|
| EP | 0 839 725 A | * | 5/1998 | B65C/9/18 |
| JP | 02-191136 | * | 7/1990 | B65C/9/18 |
| NL | 7407728 | | 12/1975 | |

OTHER PUBLICATIONS

Translation of Japanese Patent Document No. 02–191136.*

* cited by examiner

*Primary Examiner*—Richard Crispino
*Assistant Examiner*—Sue A. Purvis
(74) *Attorney, Agent, or Firm*—Thompson Hine LLP

(57) ABSTRACT

A label applying apparatus is formed by a wand assembly including a first portion having a vacuum opening for connection to a vacuum source, and a second portion movable relative to the first portion along an axis of the wand assembly to define at least a non-extended position and an extended position. A biasing member may be provided for urging the wand assembly into the non-extended position, the second portion including a label pick-up opening at an end thereof. Application of a vacuum to the vacuum opening of the first portion causes the wand assembly to be placed in the extended position and termination of the vacuum causes the wand assembly to return to the non-extended position.

29 Claims, 5 Drawing Sheets

VACUUM ACTUATED LABEL APPLYING WAND

FIELD OF THE INVENTION

The present invention relates generally to label applying apparatus such as those used in connection with food product weigh, wrap and label systems and, more particularly, to a vacuum actuated label applying wand.

BACKGROUND OF THE INVENTION

In the label applying art the use of wands which pivot from a label pick-up station to a label applying station for transferring a label from the label pick-up station to the label applying station is known. The wand picks up a label from the pick-up station when a vacuum or partial vacuum is applied to the wand in order to attract the label to an opening at the end of the wand, which opening may be formed by a vacuum cup or other member. For example, U.S. Pat. Nos. 4,561,921, 4,787,953, 4,895,614, and 5,221,405, the specifications of which are hereby incorporated by reference, are representative of label applying mechanisms which utilize wands which are pivoted between label pick-up stations and label applying stations. Typically the label pick-up station is directly above the label applying station and the wand is pivoted to face the label pick-up opening upward for receiving a label from the label pick-up station. The wand is then pivoted to face the label pick-up opening downward at the label applying station where a stripper plate or head removes the label from the end of the wand and presses the label into contact with a package moving along a conveyor.

In such label applying systems positioning of the wand can be critical to achieve proper operation, particularly where the vacuum system used to attract the labels is not strong. For example, labels are typically delivered to the label pick-up station after being passed by a printer and removed from a roll of label stock. Labels near the inner end of the roll tend to curl when removed from the label stock due to the smaller radius of curvature near the inner end of the roll. When delivered to the label pick-up station the labels may curl upward. In this condition the labels do not present a planar surface which can be easily attracted by the label pick-up opening of the wand. Further, even where labels are not curved, limitations in the applied vacuum can make positioning of the wand critical and difficult. If the end of the wand is too high when it moves to the label pick-up station it may run into the edge of the label, but if the end of the wand is too low when it moves to the label pick-up station it may not be close enough to attract the label properly. In such situations significant time may be spent adjusting the position of the wand to achieve suitable operation.

Accordingly, it would be desirable to provide a wand which enables suitable label pick-up without requiring significant and timely adjustments.

SUMMARY OF THE INVENTION

As used herein the term "vacuum" is intended to broadly encompass partial vacuums as well as full vacuums.

In one aspect of the present invention, a label applying apparatus is formed by a wand assembly including a first portion having a vacuum opening for connection to a vacuum source, and a second portion movable relative to the first portion along an axis of the wand assembly to define at least a non-extended position and an extended position. A first chamber is defined between the first portion and the second portion, the first chamber in fluid communication with the vacuum opening. A second chamber is spaced from the first chamber, the second chamber in fluid communication with ambient atmosphere. A sealing member is provided between the first chamber and the second chamber. Application of a vacuum to the vacuum opening creates a low pressure condition in the first chamber which causes the second portion to move axially away from the first portion in order to reduce the size of the first chamber, the movement of the second portion placing the wand assembly in the extended position. In application, the wand assembly can be maintained in the non-extended position in order to assure the end of the wand assembly does not run into the edge of a label during movement toward the label pick-up station, and the wand assembly can then be placed in the extended position to assure a label pick-up opening of the wand assembly is close enough to the label to properly attract it.

In another aspect of the invention, a label applying apparatus is formed by a wand assembly including a first portion having a vacuum opening for connection to a vacuum source, and a second portion movable relative to the first portion along an axis of the wand assembly to define at least a non-extended position and an extended position. A biasing member is provided for urging the wand assembly into the non-extended position. The second portion includes a label pick-up opening at an end thereof. Application of a vacuum to the vacuum opening of the first portion causes the wand assembly to be placed in the extended position and termination of the vacuum causes the wand assembly to return to the non-extended position.

Still another aspect of the invention provides a method for transferring a label to a label applying station for application to a package traveling along a conveyor which involves (a) providing a vacuum actuated wand assembly including a first portion and a second portion movable relative to each other to define an extended position and a non-extended position of the wand assembly, the wand assembly movable between the non-extended position and the extended position when a vacuum is applied to a passage of the first portion, the first portion connected to a wand assembly pivoting location, a label pick-up opening positioned at an end of the second portion and in fluid communication with the vacuum source when the wand assembly is in the extended position; (b) pivoting the wand assembly toward the label-pick-up station while in the non-extended position; (c) applying a vacuum to the wand assembly when the label pick-up opening reaches a defined position, the vacuum placing the wand assembly in the extended position and attracting the label to the label pick-up opening; and (d) pivoting the wand assembly toward the label applying station.

DETAILED DESCRIPTION

Figures 1, 2:
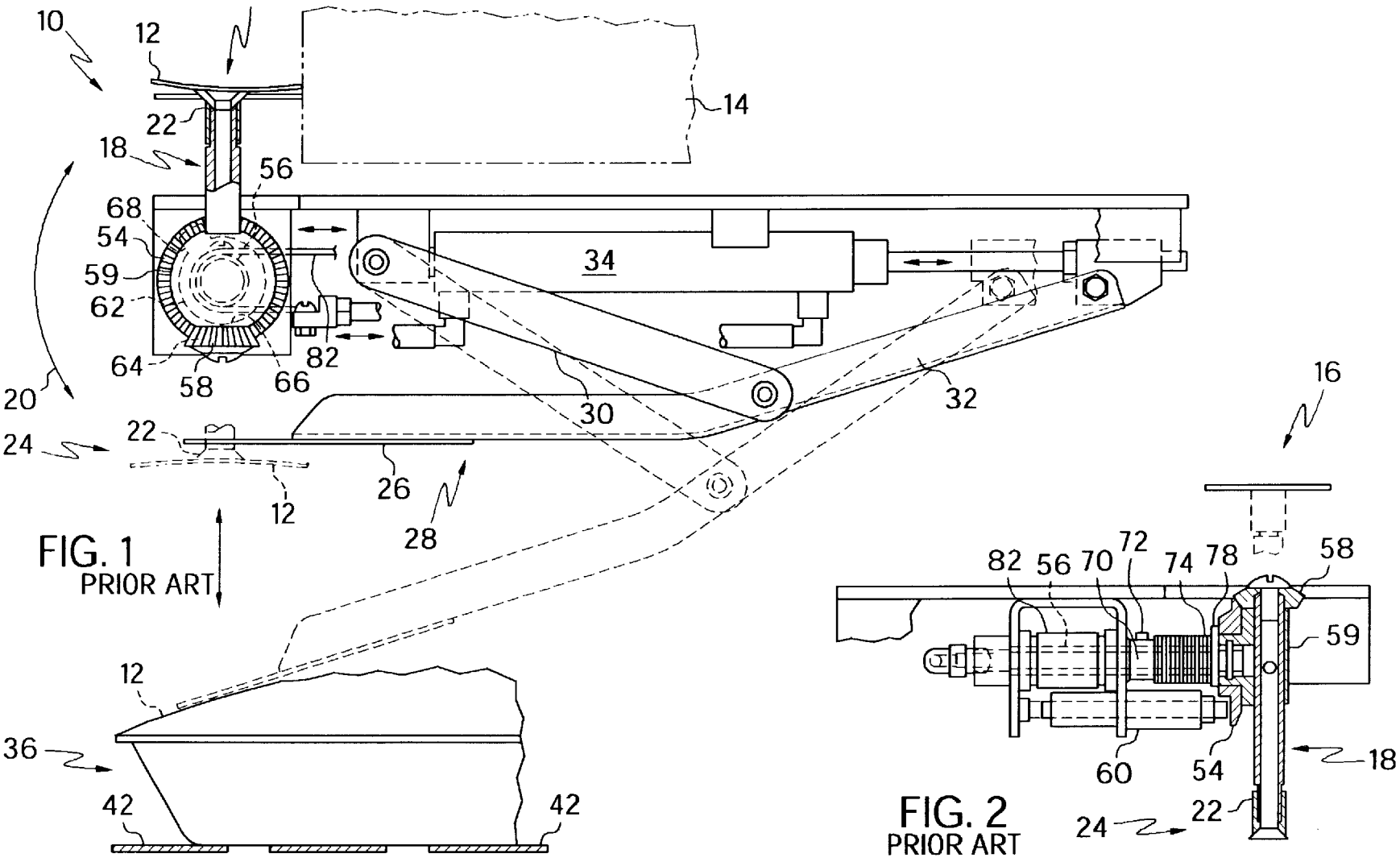
FIG. 1 PRIOR ART
FIG. 2 PRIOR ART
FIG. 1 is a fragmentary side elevational view of a prior art label applier and label stripper showing the parts in their fall line positions at the time of receiving a label, and in dotted line positions as the label is stripped from the applier and applied to a package.
FIG. 2 is a view of the applier of FIG. 1 looking from the left end in the direction of the arrow 2, but with the parts in the positions they occupy with the label at the delivery station.
Figure 3:
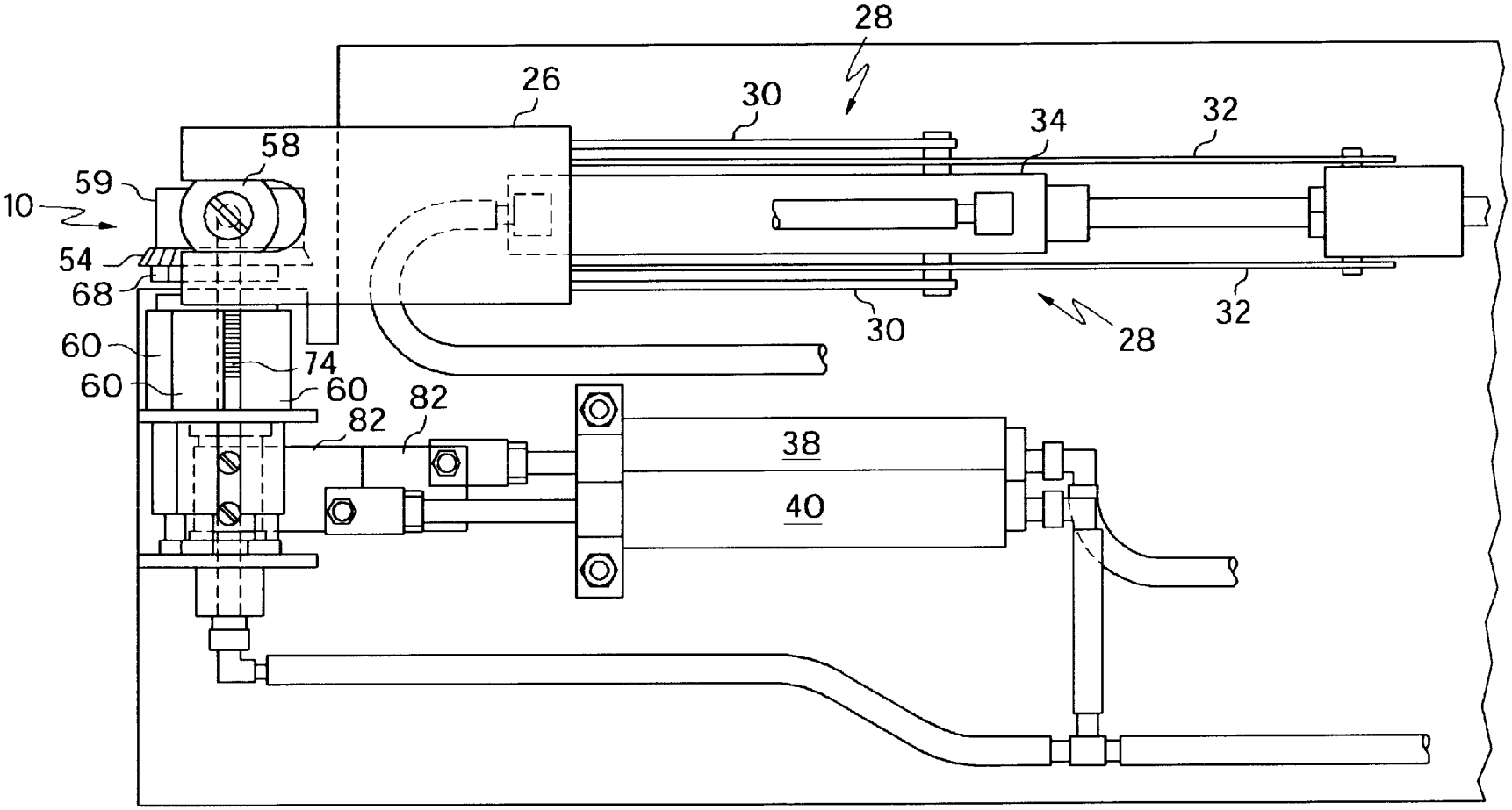
FIG. 3 PRIOR ART
FIG. 3 is a view from underneath as seen looking in the direction of arrow 3 of FIG. 1.

Referring to drawing FIGS. 1–3, a prior art labeling system in accordance with that shown and described in U.S. Pat. No. 5,22,045 is shown. In FIG. 1, a label applier 10 is shown receiving an inverted label 12 from a printer and memory controller 14. The system depicted preferably utilizes self-adhesive thermal labels, the most common labels in use today for meat and produce packages in supermarkets, but other label types may be used. Such labels are typically carried on a release-type backing strip which intermittently carries labels on demand to a thermal print head of the printer 14, where they are printed and then forwarded to a label pick-up station 16. Labels arriving at the station 16 are inverted and the backing strip may be stopped with only a thin strip of the trailing edge of the label being retained on the backing strip to hold the label steady for receipt by a vacuum wand or tube 18. The wand 18 pivots downwardly along arrow 20 to the dotted line position of the vacuum cup, sucker, or other label pick-up member 22 at the end of the wand 18, where it arrives at a label applying or delivery station 24. As the label reaches the applying station 24, it is positioned below a stripper plate 26 of a label stripping assembly 28. The assembly includes pairs of pivotally-connected scissor-action arms 30 and 32 which are activated by an air cylinder 34 to cause the stripper plate 26 to remove the label 12 from the sucker 22 and slap it onto a package 36 moving along a package conveyor 42. Timed vacuum means (not shown) applies vacuum to the sucker 22 at the time of pick-up of a label, maintains it "on" throughout its travel to the delivery station and releases vacuum just as the cylinder 34 performs the stripping function.

The conveyor 42 of the above system may be a stand-alone unit for carrying previously-wrapped packages (or any article to be labeled, for that matter). However, in most cases the conveyor 42 is part of an automatic wrapping machine such as that described in U.S. Pat. No. 4,813,211.

The subject system 10 enables labels to be rotated as they are moved from station 16 to station 24. In particular, a drive bevel gear 54 freely mounted on a hollow pivotal shaft 56. Gear 54 meshes with a driven bevel gear 58 which is fixed to pivot with shaft 56. Gear 58 is carried at an end of the wand 18 and rotates the wand on its axis to turn the label whenever required to do so. The wand 18 is journalled on its axis in a head member 59 carried on and fixed to the end of the shaft 56. The arrangement of the shaft and gears is such that, if the gear 54 pivots for the full rotational stroke of the shaft, which in the disclosed design is 180 degrees, driven gear 58 remains non-rotational and the label is merely inverted. The label will then be applied to the top of the package. Conventional air passages are provided through the hollow shaft 56 and center of wand 18 to communicate vacuum to the sucker 22 or other label pick-up member which could simply be the end of the tube. If the label is to be placed in any other angular position the drive gear 54 is arrested and stopped from further movement part way through the rotational stroke of the shaft 56. When so arrested, the driven gear 58, since designed to pivot with shaft 56, commences to rotate the wand and turn the label. The amount of label turning is controlled by the position in which drive gear 54 stops in its movement toward the delivery station 24. The gear 54 stops in response to that one of three electric solenoids 60 which is activated to cause one of intercepting pins 62, 64 or 66 to engage an abutment 68 on the back side or back face of gear 54. These pins may be armatures of the solenoids 60 and are moved into intercepting positions in response to an electrical signal from the controller 52. The selected solenoid is activated when the wand 18 is in the upright position at the pick-up station 16, but in any event, before the abutment 68 pivots to the location of pin 62.

As referred to only generally previously, shaft 56 is pivoted through an angle of 180 degrees. This is accomplished through a reversing belt drive 82 shown in FIG. 1. The belt drive is pulled in opposite directions through application of timed vacuum as required to move the wand in the directions of arrow 20. Opposite ends of the belt drive 82 are connected to cylinders 38 and 40 (FIG. 3). Conventional threaded adjustments are provided at the connection of the belt ends to the shafts of the pistons of cylinders 38 and 40 to properly place the label applier in the correct starting and stopping locations for receipt and delivery of labels.

The wand 18 of the prior art system of FIGS. 1–3 is comprised of a single hollow tubular member. The radial length of the wand from the center of pivot or rotation always remains the same. As previously indicated, if the end of the wand is too high when it moves to the label pick-up station 16 it may run into the edge of the label, but if the end of the wand is too low when it moves to the label pick-up station 16 it may not be close enough to attract the label properly. In such situations significant time may be spent adjusting the position of the wand to achieve suitable operation.

Figure 4A:
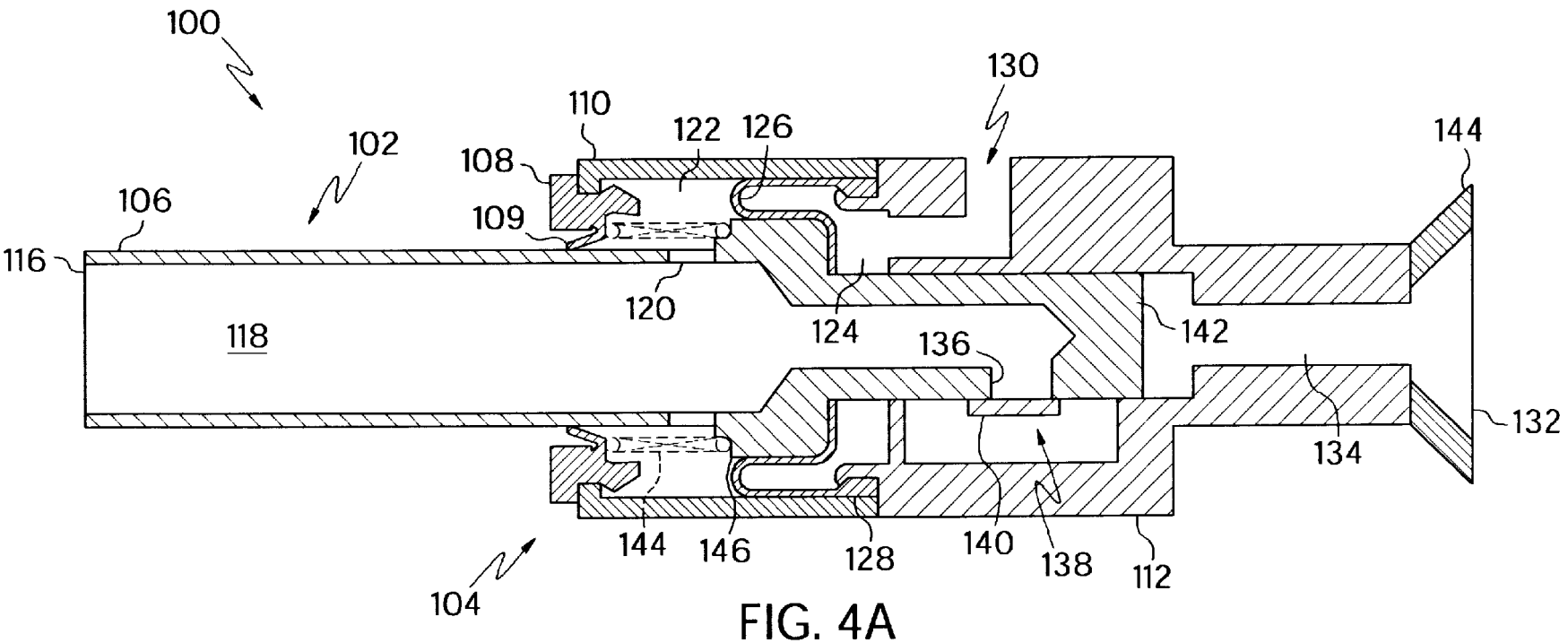
FIG. 4A is a cross-sectional view of one embodiment of a vacuum actuated wand assembly in a non-extended position.
Figure 4B:
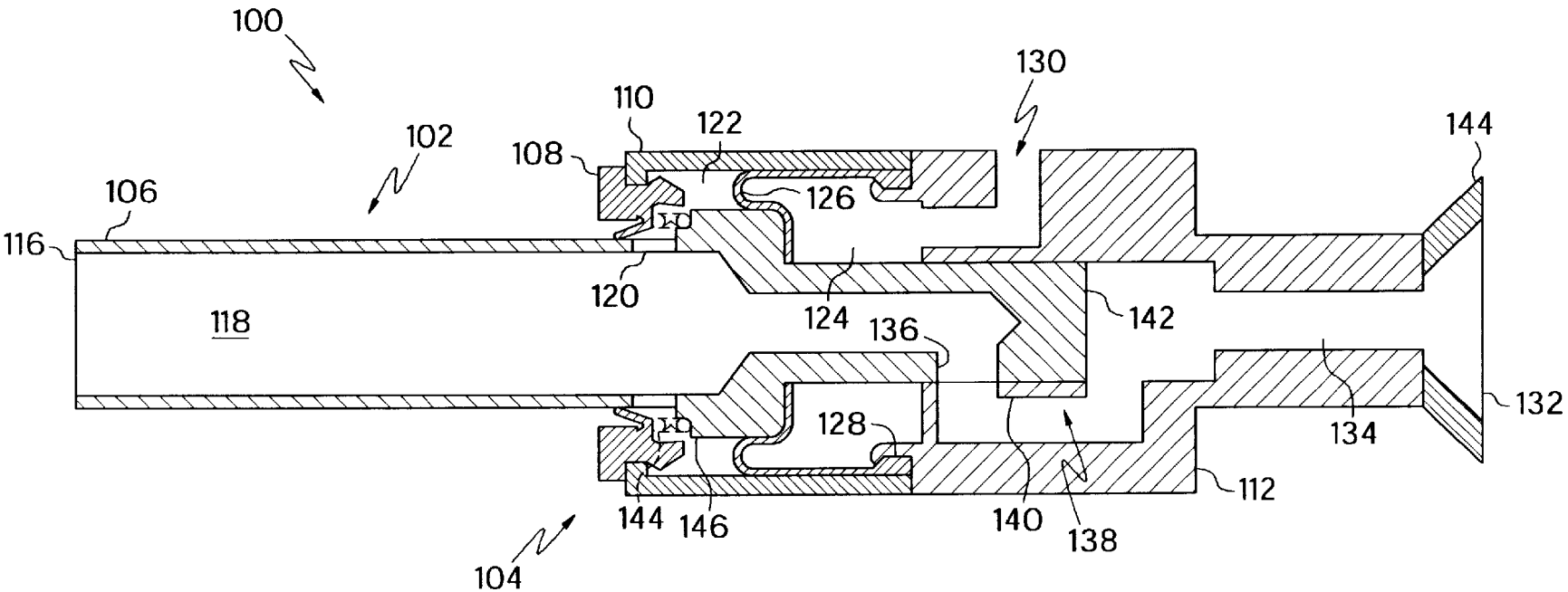
FIG. 4B is a cross-sectional view of the wand assembly of FIG. 4A in an extended position.

One embodiment of a vacuum actuated, length adjustable wand assembly 100 is shown in the cross-sectional views of FIGS. 4A and 4B. FIG. 4A represents the wand assembly 100 when in a non-extended position while FIG. 4B represents the wand assembly 100 when in an extended position. The wand assembly 100 includes a portion 102 and a portion 104, with the two portions movable relative to each other to provide the extended and non-extended positions.

In the illustrated embodiment, portion 102 is formed by a unitary tubular member 106 and portion 104 is formed by cap member 108, intermediate housing member 110, front housing member 112 and vacuum cup 114. The tubular member 106 includes a vacuum opening 116 at its end for connection to a vacuum source. The vacuum opening 116 leads to a vacuum passage 118. It is recognized that the vacuum opening could also be provided as a radial or lateral opening along the member 106. A radial or lateral port 120 connects the passage 118 to a chamber 122 formed between the portion 102 and portion 104. Cap member 108 includes a flexible radial flange 109 which engages and rides along the outer surface of member 106 during relative movement between the two portions 102 and 104. Flange 109 also acts as a sealing member for chamber 122, and the chamber 122 is closed off from ambient atmosphere but open to the vacuum passage 118.

Adjacent the chamber 122 is a chamber 124, with a sealing member such as bellows 126 positioned between the chambers. The bellows 126 includes a radially inner edge connected to an outer surface of the member 106 and a radially outer edge connected in an annular passage 128 formed between member 110 and member 112. The bellows 126 is flexible to permit relative movement between the portion 102 and portion 104. Chamber 124 may not be necessary where the side of the sealing member opposite the chamber 122 is completely open. Similarly, the size and shape of either chamber 122 and 124 could vary greatly. A passage 130 maintains the chamber 124 in communication with ambient atmosphere. The vacuum cup 114 defines a label pick-up opening 132 of portion 104 which leads to a fluid passage 134 extending within member 112.

While a perfect seal is preferred between chamber 122 and ambient atmosphere and between chamber 122 and chamber 124, it is recognized that passage of minor amounts of air into the chamber 122, whether from chamber 124 or directly from the space surrounding chamber 122 will not prevent the wand assembly from operating properly.

In the illustrated embodiment portion 102 is telescopingly received within portion 104. When in the non-extended position of FIG. 4A, fluid communication between a radial or lateral transfer port 136 of member 106 and an axial transfer port 138 of member 112 is blocked by an axially and circumferentially aligned wall 140 of member 112. Similarly, transfer port 138 is closed off from passage 134 via overlap between the end 142 of member 106 and a sidewall of the passage 134. When the wand assembly 100 is moved to the extended position of FIG. 4B, the transfer port 136 aligns with transfer port 138, and the end 142 of member 106 moves away from the sidewall of passage 134, to provide fluid communication between label pick-up opening 132 and vacuum opening 116 via passage 134, transfer port 138, transfer port 136 and passage 118. A spring 144 positioned between a protruding radial edge 146 along member 106 and a side of cap member 108 urges the wand assembly 100 into the non-extended position of FIG. 4A.

Application of a vacuum to vacuum opening 116 creates a low pressure condition in chamber 122 via passage 118 and port 220. Because chamber 124 is open to ambient atmosphere via passage 130, a pressure differential between chamber 122 and passage 124 results. The low pressure chamber 122 therefore has a tendency to want to reduce in size, creating an axial force which moves portion 104 away from portion 102 (assuming the position of the first portion is fixed), overcoming the urging force of the spring 144 to place the wand assembly in the extended position. If the vacuum applied at vacuum opening 116 is terminated, the pressure differential is removed and the spring 144 urges portion 104 back toward portion 102 to again place the wand assembly in the non-extended position of FIG. 4A. Thus the creation of a pressure differential across the sealing member triggers the extension of the wand. Rather than using the spring as a return mechanism, supplying pressurized air to chamber 122 could also place the wand assembly in the non-extended position.

In operation the exposed end of member 106 is fixedly positioned to a wand pivoting or rotating assembly such as that described above in FIGS. 1–3. As the wand assembly 100 is pivoted from the label delivery station 24 to the label pick-up station 16, no vacuum is applied to the wand assembly and the wand assembly 100 is maintained in the non-extended position, assuring that the end of the wand assembly 100 will clear the edge of the label 12. Once the end of the wand assembly has reached a defined position, at least clearing the edge of the label, and typically when the wand assembly movement has been completed and the label pick-up opening reaches its end of movement position, a vacuum is applied to the wand assembly 100 causing the wand assembly 100 to be placed in the extended position. In the extended position the label pick-up opening 132 is moved toward the label 12 to assure that the opening 132 is close enough to the label 12 to attract and pick-up the label 12. The wand assembly 100 is then pivoted back toward the label delivery station 24 while in the extended position. The stripper plate 26 then removes the label 12 from the end of the wand assembly 100 and applies it to a package. As the label 12 is removed from the wand assembly 100 the vacuum applied at opening 116 may be terminated allowing the wand assembly to return to the non-extended position before being pivoted back to the label pick-up station 16.

Movement of the wand pivoting assembly and application of the vacuum can be controlled via a controller for coordinating timing between movement and application of the vacuum. The controller maybe an electronic controller, a pure mechanical linkage, or a combination of the two. For example, a cam driven system in which an air bag produces the vacuum may be used.

Figure 5:
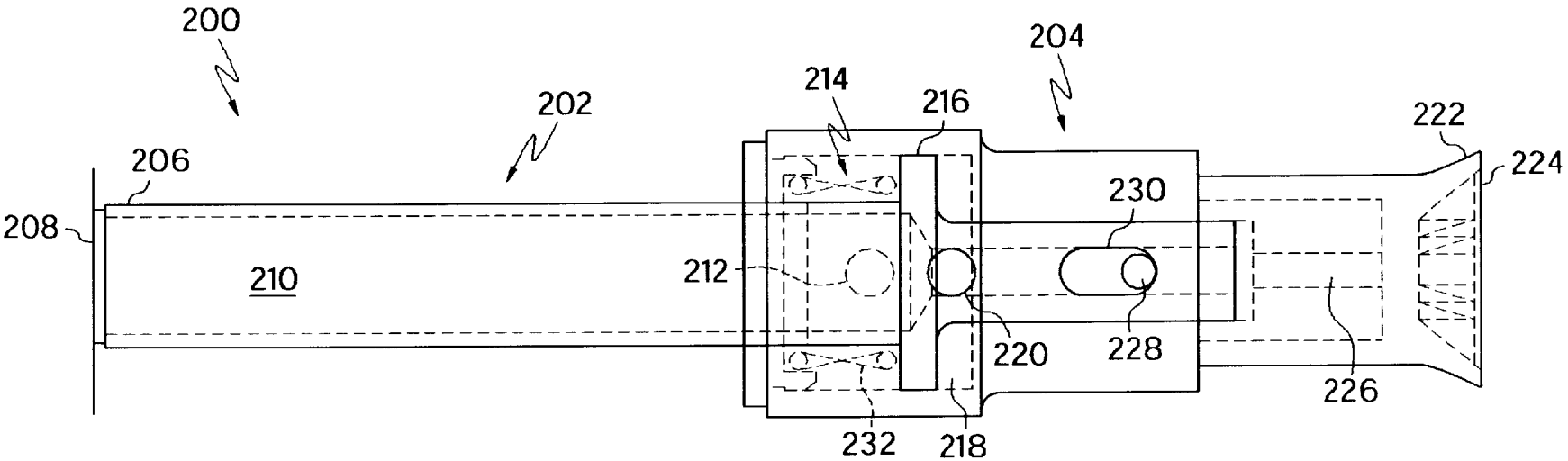
FIG. 5 shows an alternative embodiment of a vacuum actuated wand assembly.

Another embodiment of an exemplary wand assembly 200 is shown in FIG. 5. Wand assembly 200 includes portions 202 and 204 arranged in a telescoping manner and axially movable relative to each other. Portion 202 is formed by unitary member 206 having a vacuum opening 208, a vacuum passage 210 and a lateral or radial port 212 which leads to a chamber 214 defined between portion 202 and portion 204. A sealing member in the form of a piston 216 separates chamber 214 from a chamber 218. Chamber 218 is open to ambient atmosphere via a port 220. A vacuum cup 222 or other label pick-up member defines a label pick-up opening 224 at the end of the wand assembly 200. A passage 226 extends away from opening 224 back toward portion 202. Alignable transfer ports (not shown) from passage 210 to passage 226 provide fluid communication between the vacuum opening 208 and label pick-up opening 224 at least when the wand assembly is in an extended position, in a manner similar to ports 136 and 138 of wand assembly 100. The wand assembly 200 includes a protrusion 228 extending from member 206 into a slot 230 of portion 204. The combination of protrusion 228 and slot 230 prevents relative rotation between portion 202 and 204, and also limits the permissible axial movement between portions 202 and 204. It is recognized that wand assembly 100 could likewise have anti-rotation structure associated therewith. In wand assembly 200, a return spring 232 is positioned between the piston 216 and an interior end surface of portion 204 for urging the wand assembly 200 into the non-extended position. The manner of operation of wand assembly 200 is similar to that of wand assembly 100, where a vacuum applied at vacuum opening 208 causes the wand assembly 200 to move to the extended position and termination of the vacuum allows the spring 232 to return the wand assembly 200 to the non-extended position.

When installed in a labeling apparatus such as that shown in FIGS. 1–3, either of the subject wand assemblies provide a method for transferring a label to a label applying station for application to a package traveling along a conveyor. The method involves (a) providing a vacuum actuated wand assembly including a first portion and a second portion movable relative to each other to define an extended position and a non-extended position of the wand assembly, the wand assembly movable between the non-extended position and the extended position when a vacuum is applied to a passage of the first portion, the first portion connected to a wand assembly pivoting location, a label pick-up opening positioned at an end of the second portion and in fluid communication with the vacuum source when the wand assembly is in the extended position; (b) pivoting the wand assembly toward the label-pick-up station while in the non-extended position; (c) applying a vacuum to the wand assembly when the label pick-up opening reaches a defined position, the vacuum placing the wand assembly in the extended position and attracting the label to the label pick-up opening; and (d) pivoting the wand assembly toward the label applying station.

Although the invention has been described and illustrated in detail it is to be clearly understood that the same is intended by way of illustration and example only and is not intended to be taken by way of limitation. For example, while a piston and bellows have been illustrated as sealing members, it is recognized that other sealing members such as an o-ring or sealing ring could likewise be used.

Accordingly, the spirit and scope of the invention are to be limited only by the terms of the appended claims.

What is claimed is:

1. A label applying apparatus, comprising:

a wand assembly including a first portion having a vacuum opening for connection to a vacuum source, a second portion movable relative to the first portion along an axis of the wand assembly to define at least a non-extended position and an extended position, a first chamber defined between the first portion and the second portion, the first chamber in fluid communication with the vacuum opening, wherein application of a vacuum to the vacuum opening creates a low pressure condition in the first chamber which causes the second portion to move axially away from the first portion in order to reduce the size of the first chamber, the movement of the second portion placing the wand assembly in the extended position.

2. The apparatus of claim 1 wherein the wand assembly includes a second chamber spaced from the first chamber, the second chamber in fluid communication with ambient atmosphere, a sealing member between the first chamber and the second chamber.

3. The apparatus of claim 2 wherein the sealing member comprises a piston slidable relative to one of the first portion and the second portion.

4. The apparatus of claim 2 wherein the sealing member comprises a bellows having a first edge connected to the first portion and a second edge connected to the second portion.

5. The apparatus of claim 1 wherein the wand assembly further comprises a label pick-up opening at an end of the second portion, a fluid passage within the second portion which leads to the label pick-up opening, the fluid passage in communication with the vacuum opening at least when the wand assembly is in the extended position.

6. The apparatus of claim 5 wherein the fluid passage is in fluid communication with the vacuum opening when the wand assembly is in both the extended position and the non-extended position.

7. The apparatus of claim 5 wherein the fluid passage is closed off from the vacuum opening when the wand assembly is in the non-extended position, wherein the first portion includes a vacuum passage leading from the vacuum opening to a first transfer port, wherein the fluid passage of the second portion leads to a second transfer port, wherein the first and second transfer ports are closed off from each other when the wand assembly is in the non-extended position, and wherein the first and second transfer ports are moved into fluid communication at least when the wand assembly is in the extended position.

8. The apparatus of claim 1, further comprising a spring positioned between the first portion and the second portion for urging the wand assembly into the non-extended position.

9. The apparatus of claim 1, wherein application of pressurized air to the vacuum opening when the wand assembly is in the extended position creates a high pressure condition in the first chamber which causes the second portion to move axially toward the first portion in order to enlarge the size of the first chamber, the movement of the second portion placing the wand assembly in the non-extended position.

10. The apparatus of claim 1, further comprising:

a wand pivoting assembly for moving the wand assembly between a label pick-up station and a label applying station, an end of the first portion of the wand assembly connected thereto;

a vacuum source in communication with the vacuum opening of the wand assembly first portion;

means for controlling the wand pivoting assembly and for controlling application of the vacuum source, the means operable with the wand pivoting assembly to repeatedly move the wand assembly between the label pick-up station and the label applying station, the means further operable with the vacuum source to maintain the wand assembly in the non-extended position as the wand assembly is moved towards the label pick-up station and until the wand assembly reaches a defined position.

11. The apparatus of claim 1 wherein the first portion and second portion are arranged in a telescoping manner.

12. The apparatus of claim 11 wherein an end of the first portion is positioned within and end of the second portion.

13. The apparatus of claim 1, further comprising means for preventing rotational movement of the second portion relative to the first portion.

14. In a labeling apparatus including a label pick-up station, a method for transferring a label to a label applying station for application to a package, comprising:

(a) providing a vacuum actuated wand assembly including a first portion and a second portion movable relative to each other to define an extended position and a non-extended position of the wand assembly, the wand assembly movable between the non-extended position and the extended position when a vacuum is applied to a passage of the first portion, the first portion connected to a wand assembly pivoting location, a label pick-up opening positioned at an end of the second portion and in fluid communication with the vacuum source when the wand assembly is in the extended position;

(b) pivoting the wand assembly toward the label-pick-up station while in the non-extended position;

(c) applying a vacuum to the wand assembly when the label pick-up opening reaches a defined position, the vacuum placing the wand assembly in the extended position and attracting the label to the label pick-up opening;

(d) pivoting the wand assembly toward the label applying station.

15. The method of claim 14 wherein in step (d) a pressure differential between two chambers defined between the first and second portions causes the wand assembly to be placed in the extended position.

16. The method of claim 15 wherein the two chambers are separated by one of a bellows and a piston.

17. The method of claim 14 wherein step (d) involves placing a vacuum passage of the first portion in fluid communication with a fluid passage of the second portion when the wand assembly is placed in the extended position, wherein the fluid passage of the second portion is in fluid communication with the label pick-up opening.

18. The method of claim 14 wherein the defined position precedes an end of movement position of the label pick-up opening.

19. The method of claim 14 wherein the defined position is at an end of movement position of the label pick-up opening.

20. A label applying apparatus, comprising:

a wand assembly including a first portion having a vacuum opening for connection to a vacuum source, a second portion movable relative to the first portion along an axis of the wand assembly to define at least a non-extended position and an extended position, the second portion including a label pick-up opening at an end thereof, wherein application of a vacuum to the vacuum opening of the first portion causes the wand assembly to be placed in the extended position.

21. The apparatus of claim 20 further comprising a biasing member for urging the wand assembly into the non-extended position, and termination of the vacuum causes the wand assembly to return to the non-extended position.

22. The apparatus of claim 20 further comprising:

a first chamber defined between the first portion and the second portion, the first chamber in fluid communication with the vacuum opening and closed off from ambient atmosphere, a second chamber spaced from the first chamber, the second chamber in fluid communication with ambient atmosphere, a sealing member between the first chamber and the second chamber, wherein application of a vacuum to the vacuum opening creates a low pressure condition in the first chamber which causes the second portion to move axially away from the first portion in order to reduce the size of the first chamber, the movement of the second portion placing the wand assembly in the extended position.

23. The apparatus of claim 20, further comprising:

a wand pivoting assembly for moving the wand assembly between a label pick-up station and a label applying station, an end of the first portion of the wand assembly connected to the wand pivoting assembly;

a vacuum source in communication with the vacuum opening of the wand assembly first portion;

means for controlling the wand pivoting assembly and for controlling application of the vacuum source, the means operable with the wand pivoting assembly to repeatedly move the wand assembly between the label pick-up station and the label applying station, the means further operable with the vacuum source to maintain the wand assembly in the non-extended position as the wand assembly is moved towards the label pick-up station and until the wand assembly reaches a defined position.

24. A label applying apparatus, comprising:

a wand assembly including a first portion having a vacuum opening, a second portion movable relative to the first portion along an axis of the wand assembly to define at least a non-extended position and an extended position, a first chamber defined between the first portion and the second portion, the first chamber in fluid communication with the vacuum opening, a second chamber spaced from the first chamber, the second chamber in fluid communication with ambient atmosphere, a sealing member between the first chamber and the second chamber, wherein a pressure differential between the first chamber and second chamber will cause relative movement between the first portion and the second portion.

25. The apparatus of claim 24 wherein the wand assembly further comprises a label pick-up opening at an end of the second portion, a fluid passage within the second portion which leads to the label pick-up opening, the fluid passage in communication with the vacuum opening at least when the wand assembly is in the extended position.

26. The apparatus of claim 24 wherein the fluid passage is closed off from the vacuum opening when the wand assembly is in the non-extended position, wherein the first portion includes a vacuum passage leading from the vacuum opening to a first transfer port, wherein the fluid passage of the second portion leads to a second transfer port, wherein the first and second transfer ports are closed off from each other when the wand assembly is in the non-extended position, and wherein the first and second transfer ports are moved into fluid communication at least when the wand assembly is in the extended position.

27. The apparatus of claim 24 wherein the sealing member comprises a piston slidable relative to one of the first portion and the second portion.

28. The apparatus of claim 24 wherein the sealing member comprises a bellows.

29. The apparatus of claim 24, further comprising a spring positioned between the first portion and the second portion for urging the wand assembly into the non-extended position.

* * * * *